US006786484B2

(12) United States Patent
Smith

(10) Patent No.: US 6,786,484 B2
(45) Date of Patent: Sep. 7, 2004

(54) SHEET INVERTER

(75) Inventor: Richard W. Smith, Salem, OH (US)

(73) Assignee: Sebring Container Corp., Salem, OH (US)

( * ) Notice: Subject to any disclaimer, the term of this patent is extended or adjusted under 35 U.S.C. 154(b) by 13 days.

(21) Appl. No.: 10/253,696

(22) Filed: Sep. 25, 2002

(65) Prior Publication Data

US 2004/0056412 A1 Mar. 25, 2004

(51) Int. Cl.[7] ..... B65H 39/10
(52) U.S. Cl. ..... 271/291
(58) Field of Search ..... 198/403; 271/291; 414/753, 796.3

(56) References Cited

U.S. PATENT DOCUMENTS 2,386,925 A * 10/1945 Beck et al. ..... 414/758
3,581,868 A * 6/1971 French et al. ..... 198/379
4,175,655 A * 11/1979 Baldwin ..... 197/403
5,341,910 A * 8/1994 Sauer ..... 198/403
5,743,374 A * 4/1998 Monsees ..... 198/403

FOREIGN PATENT DOCUMENTS

JP 55-48115 * 4/1980
JP 57-19217 * 2/1982

* cited by examiner

*Primary Examiner*—Donald P. Walsh
*Assistant Examiner*—Kenneth W Bower
(74) *Attorney, Agent, or Firm*—Jones, Tullar & Cooper PC

(57) ABSTRACT

Stacks of flexible sheets, such as printed slotted and scored corrugated paperboard box blanks, are inverted during travel along a sheet stacker. A plurality of sheet inverter fingers, each with a friction enhancing surface on a free end, are interdigitated between the belts of the sheet stacker. These fingers engage the leading ends of the stacks and invert the stacks during continued forward travel of the stacks.

26 Claims, 13 Drawing Sheets

300
120 VAC
NEU.
310
312
313
314
315
316
317
318
319
322
321
80
323
325
324
327
328
326
329
330
220
332
334
333
94
222
224
337
338
341
342
339
340
343
344
345
346
347
348
349
230

SHEET INVERTER

FIELD OF THE INVENTION

The present invention is directed generally to a sheet inverter. More particularly, the present invention is directed to a sheet inverter useable to invert flexible sheets. Most specifically, the present invention is directed to a sheet inverter for repositioning sheets of flexible corrugated paperboard stock useable in the fabrication of cartons. The corrugated sheets, which are typically printed, scored and slotted, are quite flexible and are positioned on a plurality of spaced belt conveyors which form a sheet stacker. The sheet inverter repositions these corrugated sheets of paperboard by inverting them during their conveyance on the sheet stacker and prior to delivery of the sheets to a sheet stack hopper. The sheet inverting can be accomplished on individual sheets. More typically, a plurality of stacked sheets will be inverted as a group. The sheet inverter utilizes a plurality of sheet inverting fingers which interdigitate with the spaced belt conveyors that support the printed, slotted and scored flexible corrugated paperboard sheets being inverted.

BACKGROUND OF THE INVENTION

A great number of products are packaged, by their manufacturers, for shipping and distribution in corrugated paperboard cartons or boxes. These corrugated paperboard boxes or cartons are typically supplied to their end user; i.e. the manufacturer of the products to be boxed and shipped, in a non-erected configuration. Clearly, it is not efficient to ship or transport fully set up or erected empty paperboard boxes from the box manufacturer to a product manufacturer, who will then fill these erected corrugated paperboard cartons with his product. Rather, these corrugated paperboard cartons are shipped to the end user in a non-erected configuration. The corrugated paperboard boxes arrive at the end user's facility each folded flat as a sleeve. Each carton's bottom and top flaps are usually then folded into place and glued or taped to complete the erection of the cartons immediately before their useage. These non-erected boxes are supplied to the end user by a corrugated box manufacturer.

The corrugated box manufacturer starts with a stack of sheets of corrugated paperboard which he obtains from a supplier of corrugated sheets. The overall size of each sheet has been determined by the box manufacturer or by the end user in accordance with the size of the intended corrugated box or carton. The corrugated paperboard sheets are received by the corrugated box manufacturer from the corrugated sheet supplier typically already provided with across-corrugation score lines. These score lines will, when combined with score lines added by the corrugated box manufacturer, define lines of fold that will typically cooperate with slots cut into the corrugated sheets by the box manufacturer. In some situations, the corrugated sheets received from the supplier are not scored. In those instances, the box manufacturer must score, slot and print the corrugated sheets.

The corrugated sheets are slotted to create the carton's side panels and end flaps, and are also printed with suitable graphics, as determined by the end user. A machine, typically referred to as a printer-slotter is used for this purpose. The printer-slotter is akin to a rotary printing press and includes one or more pairs of cooperating printing rollers with the number of printing roller pairs being equal to the number of colors that can be printed. The printer-slotter also is provided with multiple pairs of cooperating scoring rollers and slotting knives. The corrugated paperboard sheets are placed, in a stack, on an infeed table of the printer-slotter. As these sheets travel individually through the printer-slotter, each is first printed and scored and is then slotted. The specific graphics printed on the sheets, the location of the slots, the scoring and the cut-outs cut into the sheets can be changed.

The printed, scored and slotted sheets are then fed to an intermediate, driven conveyor, typically referred to as a lay boy. The lay boy accumulates and transfers printed, scored and slotted corrugated paperboard box blanks to a sheet stacker and to a sheet stack hopper for collection and stacking.

A wide variety of printer-slotters are available to corrugated box manufacturers. All can be categorized by the location of their printing plates. They are thus either "top" printers or "bottom" printers. The corrugated and now printed, scored and slotted box blanks exit the printer-slotter with their printed surfaces either face up or face down, dependent on the type of printer-slotter which the corrugated box manufacturer may have. Some larger manufacturers may have one or more of either type.

Once the corrugated sheets have been printed, scored and slotted, they are typically placed in a stack by operation of the lay boy, sheet stacker and sheet stack hopper referred to above. These printed and slotted sheets are then formed into non-elected boxes by the folding of each sheet into a sleeve-like configuration. The folded sheets are formed into sleeves by a joining step such as stitching or taping of the sheet ends. After the printed, scored and slotted flexible corrugated paperboard sheets have been formed into these sleeves, they are then again stacked and suitably bound and are then sent to their end user.

The sheets are turned into sleeves by a "joiner." It is the function of the joiner to fold the sheets along their score lines and to join together the length and width panels of the partially finished box, to form the sleeves. A variety of joiners are available. Some of these form the printed, slotted and scored box blanks into non-elected sleeves by folding the length and width panels of the printed and slotted blanks down and in. Others fold the length and width panels of the blanks up and in. The printed, scored and slotted corrugated sheets provided to a joiner that fold down and in, are supplied with their printed side facing up, assuming that the printed graphics are intended to be situated on the exterior of the folded box. If the joiner folds up and in to form the intermediate sleeve, the printed, scored and slotted blanks must be situated on the joiner with their printed sides facing down.

If only a few printed, scored and slotted corrugated paperboard sheets were to be made into non-erected sleeves, the placement of the printed, scored and slotted sheets on the joiner in a print side up or print side down orientation would be a small task. However, in a corrugated box manufacturing plant, a substantial percentage of each day's output from the printer-slotter must be inverted to orient them properly for the joining step.

In the past, this inverting step has been done manually or by some makeshift arrangement. The inverting of stacks of sheets, if done manually, is quite likely to cause physical injury. It is a step that frequently requires the participation of two workers, who must leave other tasks to accomplish this one. Such manual sheet inversion places the workers at greater risk of physical injury, with its attendant health and disability costs. It also is very labor intensive and thus increases the cost of the finished product. Since the finished product is a non-erected shipping carton or container, there is a limit to the price that can be charged. All of these factors makes the need for a better, faster, more efficient and less expensive device for inverting flexible sheets of corrugated paperboard, having a wide range of sizes and weights, that much greater.

Several sheet inverting devices are known in the prior art. One of these uses a plurality of arms to invert drywall panels. The arms are provided with large rollers at their free ends. In use, a first group of arms and rollers extend underneath the leading edge of a drywall panel and raise the leading edge. A second set of arms and rollers catch the now trailing edge of the inverted panels and lowers the inverted panels onto the conveyor belt. This system is too slow for efficient use with a printer-slotter in a corrugated paperboard box manufacturing facility. It also depends on the stiffness or rigidity of the sheets to function properly.

Another type of inverting device, which is also intended for use with relatively rigid panels, such as drywall or plywood sheets, uses a group of cantilever arms that are each provided with a downwardly facing hook at their free end. These cantilever arms extend out over the path of travel of the panels. They engage the panel's leading edge with their hooks, elevate the leading edge of each panel, draw it up and back, and invert each panel as the initially trailing end is conveyed under the raised initially leading end. These devices are again too slow for useage in a relatively high speed application, such as in the inversion of sheets exiting from a corrugated paperboard sheet printer-slotter. In addition, they require a substantially rigid panel for successful operation. Paperboard sheets that have been scored and slotted generally do not have that degree of rigidity.

While the general concept of a panel inverting device is generally known in the art, none of those prior art devices are particularly suitable for accomplishing the inversion of printed, scored and slotted flexible paperboard sheets which are used in the corrugated box industry. The need exists for a sheet inverter that will accomplish the inversion of relatively flexible sheets, such as these printed, scored and slotted corrugated paperboard sheets. Since the overall sizes and weights of the sheets, as well as their conveying speeds vary widely, the device must be able to work at varying conveying speeds and with a variety of sizes and weights of corrugated sheets. It must be efficient, cost-effective, dependable and durable. It must also be adaptable for the cooperative use with other machines in a manufacturing facility and must operate using utilities that are typically available in such a manufacturing facility. The sheet inverter in accordance with the present invention overcomes the limitations of the prior art and provides a device which is a substantial improvement over the prior art.

SUMMARY OF THE INVENTION

It is an object of the present invention to provide a sheet inverter.

Another object of the present invention is to provide an inverter for flexible sheets.

A further object of the present invention is to provide a corrugated material sheet inverter.

Yet another object of the present invention is to provide a corrugated paperboard sheet inverter.

Still a further object of the present invention is to provide a sheet inverter that is useable to invert single sheets and stacks of sheets.

Even another object of the present invention is to provide a sheet inverter useable to reposition by inverting printed and slotted flexible corrugated paperboard box blanks.

As will be set forth in greater detail in the description of the preferred embodiment, the sheet inverter of the present invention is intended for use primarily to invert printed, slotted and scored paperboard box blanks that are produced by a printer-slotter. The sheet inverter is intended for use primarily in the corrugated paperboard box manufacturing industry. The printed, scored and slotted sheets exit the printer-slotter and are received by the lay boy in preparation to being forwarded to a sheet stacker. The sheet or stack of sheets are supported on the sheet stacker by a plurality of spaced conveyor belts. The sheet inverter itself utilizes a rotatable shaft that is supported above, and generally transverse to the direction of transport of the sheets. The rotatable shaft is supported at its ends by bearings. A plurality of fingers, at least some of which may be extendable, are attached at first, proximal ends to the rotatable shaft. The second, distal ends of these fingers interdigitate between the spaced conveyor belts. Each finger carries a friction enhancing material on a sheet engaging surface portion of its distal end. Each finger also carries a sheet stop intermediate its ends and adjacent the sheet engaging surface of the distal end. In operation, the sheet or stack of sheets travel along the sheet stacker, engage, and start to climb up the distal ends of the spaced fingers. A double acting pneumatic or hydraulic cylinder is actuated to rotate the shaft and to thereby raise the free, second ends of the fingers up under the forwardly traveling sheet or stack of sheets. This finger elevation, in combination with the continuing forward conveyance of the sheet or sheet stack by the conveyor belts effects an inversion of the sheet or sheet stack. The now inverted sheet or sheet stack travels onwardly on the sheet stacker to a hopper where they accumulate in a stack of sheets that can then be taken to a joiner for further processing.

The sheet inverter in accordance with the present invention, as will be discussed in detail subsequently, works in cooperation with the intermediate lay boy. At higher production speeds of the printer-slotter, as is typical with single thickness corrugated sheets, the sheet inverter could not keep pace with the printer-slotter, assuming that each sheet was inverted individually. Modification of the lay boy or another intermediate conveyor to operate intermittently results in the build-up of a stack of sheets as they come out of the printer-slotter. The sheet inverter of the present invention includes settable controls so that the number of sheets in each stack which is accumulated or built up on the lay boy, before being discharged to the sheet stacker, can be controlled. Depending on the width of each sheet and the operational speed of the printer-slotter, each stack formed on the lay boy can consist of two or more sheets. As stacks of this number of sheets are fed to the sheet inverter, they tend to displace in the direction of travel within the stack. As they are engaged by the free finger ends of the inverter, the inversion process re-aligns the stack.

The sheet inverter of the present invention provides for the control of the speed of elevation and declination of the sheet inverting fingers by controlling the flow of fluid to the chambers of the double acting pneumatic piston or pistons that rotate the shaft which carries the fingers. Again depending on the width, and the speed of travel of the sheet or stack of sheets, the lead time between the start of rotation of the shaft and the arrival of the first leading edge of the first sheet in the stack at the fingers can be controlled. Proper timing is also accomplished by the selection of a suitable rest position of the fingers in their ready position. Clearly this ready position must be one in which the free ends of the fingers are below the surface of the conveyor belts. However, further declination of the free ends of these fingers is not of benefit unless the dwell time of the fingers in their rest position is to be increased. The control arrangement of the speed of rotation of the shaft and its dwell time will insure that the sheet or stack of sheets are inverted and that the fingers are returned to their ready position all in concert with the production speed of the printer-slotter.

The sheet inverter of the present invention is readily adapted to a wide range of sizes of corrugated sheets. As discussed above, the intermittent drive of the lay boy allows the printer-slotter to operate at a higher speed. The control of the rotational speed of the finger support shaft is adjustable to accept sheets of varying widths. Suitable system controls are included to prevent the free ends of the fingers from returning to their ready position too quickly and thus disrupting the exit of the trailing portion of the prior inverted stack of sheets. If the sheets being printed and slotted are quite thick and heavy, thus requiring a slower speed of operation of the printer-slotter, the lay boy can be driven continuously. The sheet inverter can invert each sheet separately, assuming that sufficient time is provided, by operation of the printer-slotter at a low speed.

As discussed previously, printed, slotted and scored corrugated paperboard box blanks, even if arranged in stacks of several blanks or sheets, are relatively flexible. The use of the friction enhancing material on the sheet engaging surface of the free or distal ends of the fingers, together with the proper timing of operation of the sheet inverter, which allows the sheets to be supported by a finite length of each finger, accomplishes the inversion of the sheets despite their flexibility. This is very different from the prior devices that require their panels to be rigid before they can be successfully inverted. The present sheet inverter, while it will also function with rigid panels, such as wallboard or plywood, is primarily intended for use with flexible, corrugated paperboard box materials. As such, it fulfills a unique need in an area of industry which is not addressed by the prior art devices.

The sheet inverter in accordance with the present invention provides a functional, effective solution to the problem created by the need to re-orient printed, scored and slotted corrugated and non-corrugated flexible paperboard box blanks. Operation of the sheet inverter, in conjunction with a commercially available sheet stacker, or other similar sheet handling device, allows a box manufacturer to fully utilize both his printer-slotter and his joiner or joiners without the need for manual intervention in the sheet handling process. The sheet inverter of the present invention is a substantial advance in the art.

BRIEF DESCRIPTION OF THE DRAWINGS

A full and complete understanding of the sheet inverter in accordance with the present invention may be had by referring to the detailed description of the preferred embodiment, as is set forth subsequently, and as illustrated in the accompanying drawings, in which.

DESCRIPTION OF THE PREFERRED EMBODIMENTS

Figure 1:
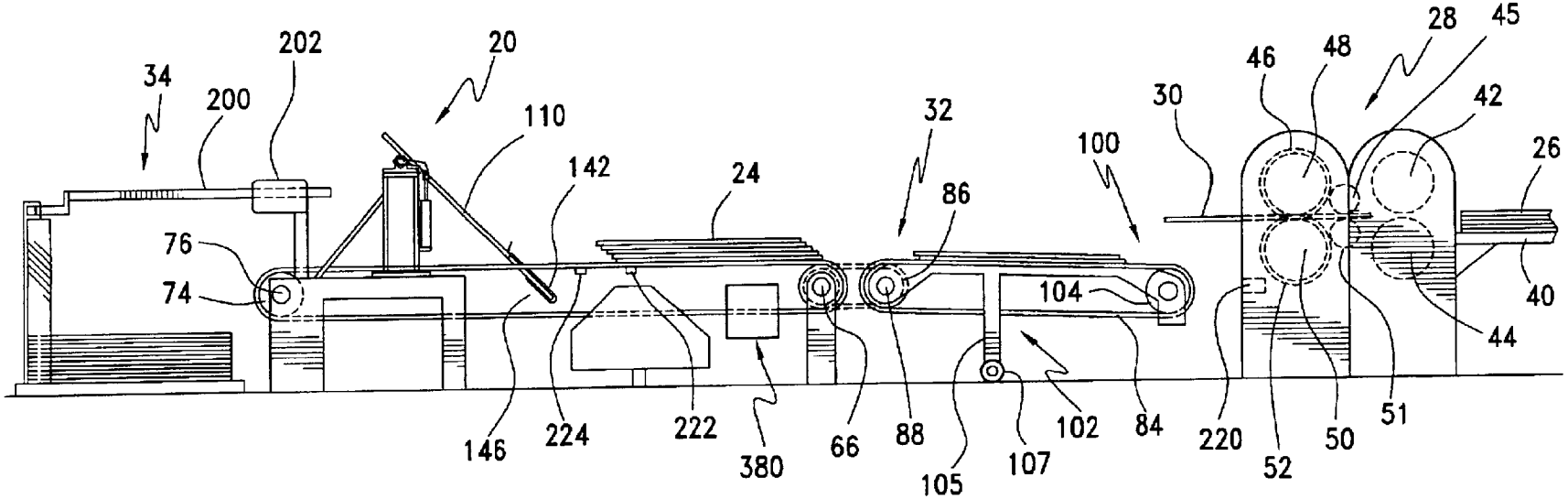
FIG. 1 is a schematic side elevation view of a preferred embodiment of a sheet inverter in accordance with the present invention and showing the sheet inverter in a ready position and supporting a stack of sheets with displaced leading and trailing edges.

Referring initially to FIG. 1, and to associated FIGS. 2 through 7 which together depict an operational sequence, there is shown, generally at 20, a sheet inverter in accordance with the present invention. Sheet inverter 20 is intended for use and is depicted as being used with a sheet stacker generally at 22. The sheet stacker 22 receives stacks 24 of printed, slotted and scored corrugated paperboard box blanks 30 that are fed from a supply stack of corrugated sheets 26 to a printer-slotter, generally at 28. Each printed, scored and slotted corrugated box blank 30 is ejected from the printer-slotter 28 onto an intermediate conveyor or lay boy 32. As will be discussed in greater detail shortly, the lay boy 32 can either run continuously or can run in an intermittent manner. The stacks 24 of corrugated box blanks 30 are inverted by the sheet inverter 20 and are then discharged to a sheet stack hopper 34. While each of these components will be discussed in greater detail subsequently, they cooperate to transform the corrugated sheets 26 in the supply stack of sheets into the printed, slotted and scored corrugated paperboard box blanks 30 in the stacks 24. These stacks 24 will be taken from the sheet stack hopper 34 for further processing in a joiner such as a stitcher or a taper. These operations typically take place in the context of the production of non-erected corrugated cartons by a corrugated box manufacturer.

Again returning to FIG. 1, a supply of individual corrugated paperboard sheets 26 are received by the corrugated box manufacturer from a supplier. These corrugated paperboard sheets 26 may have been scored by the supplier to define intended fold lines. They arrive already cut to an overall size, as specified by the box manufacturer in accordance with the requirements of the end user; i.e. the person who will receive the non-erected corrugated cartons made by the box manufacturer and who will complete the set-up of the cartons prior to their use. The corrugated sheets 26, typically in stacks, are placed on a supply platform 40 of the printer-slotter 28. The printer-slotter 28 utilizes a print roller 42 to print suitable graphics on each paperboard sheet 26 in its printing section. In the depicted printer-slotter 28, the print roller 42 is above a cooperating counter-pressure roller or cylinder 44. This printer-slotter 28 is thus referred to as a top printer. These devices are common in the industry. It is not unusual to have both top printers and bottom printers in the same corrugated box manufacturing facility. The top printer of the printer-slotter 28 is understood to be exemplary of both.

Each corrugated paperboard sheet 26 is then scored by sets of cooperating male scoring heads 51 and female scoring anvils 45, typically by four such sets and is slotted by male slotting knives 46 which are carried on an upper shaft 48 and which cooperate with a lower shaft 50 in the slotter section of the printer-slotter 28. As is known in the art, the male slotting knives 46 on the upper shaft 48 are aligned with cooperatively shaped female slotting knives 52 on the lower shaft 50. The result of the operation of the printer-slotter 28 is the production of the printed, scored and slotted corrugated paperboard box blanks 30 which are ejected from the printer-slotter 28.

As discussed in the summary of the invention, it is frequently necessary to invert the printed, scored and slotted box blanks 30 so that the printed side will be properly oriented in the sheet stack hopper 34. This will allow the further processing of the box blanks 30 in a joiner, which is not part of the present invention, but which is typically used in a box factory to form the printed, slotted and scored box blanks 30 into the non-erected cartons which are the end product of the corrugated box factory. The sheet inverter 20 of the present invention accomplishes the inversion of stacks 24 of printed, slotted and scored corrugated box blanks 30. If the box blanks 30 are large enough, and are moving slowly, it is also possible to operate the sheet inverter 20 to invert or flip individual box blanks 30. More typically, the sheet inverter 20 is used to invert stacks 24 of box blanks 30.

Figure 8:
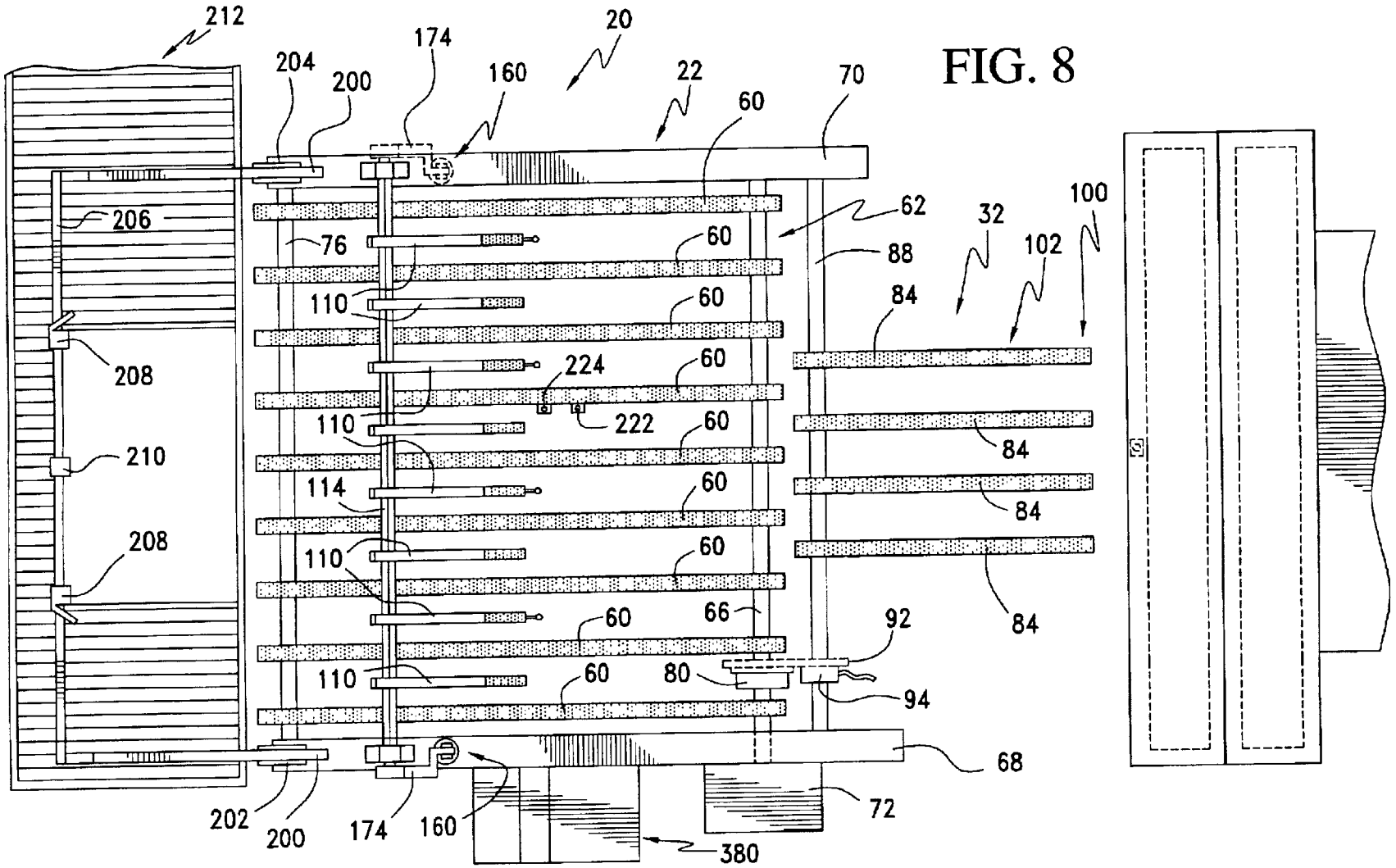
FIG. 8 is a top plan view of the sheet inverter of the present invention.
Figures 11, 12:
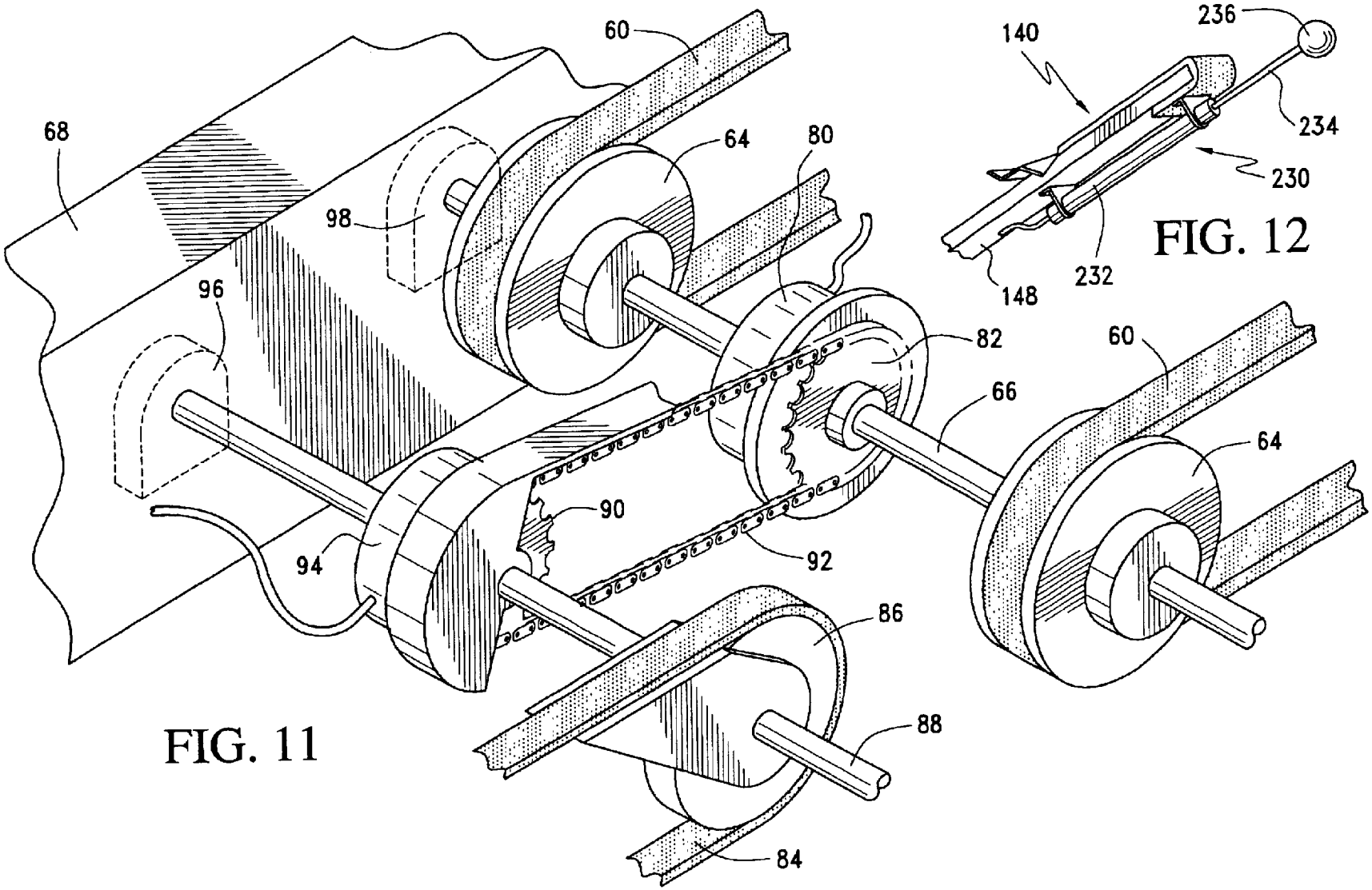
FIG. 11 is a perspective view of a portion of the lay boy and sheet stacker and showing the clutch and brake assemblies of the present invention.
FIG. 12 is a perspective view of one of the sheet inverting fingers and showing an extendable finger extension in accordance with the present invention.
Figure 13:
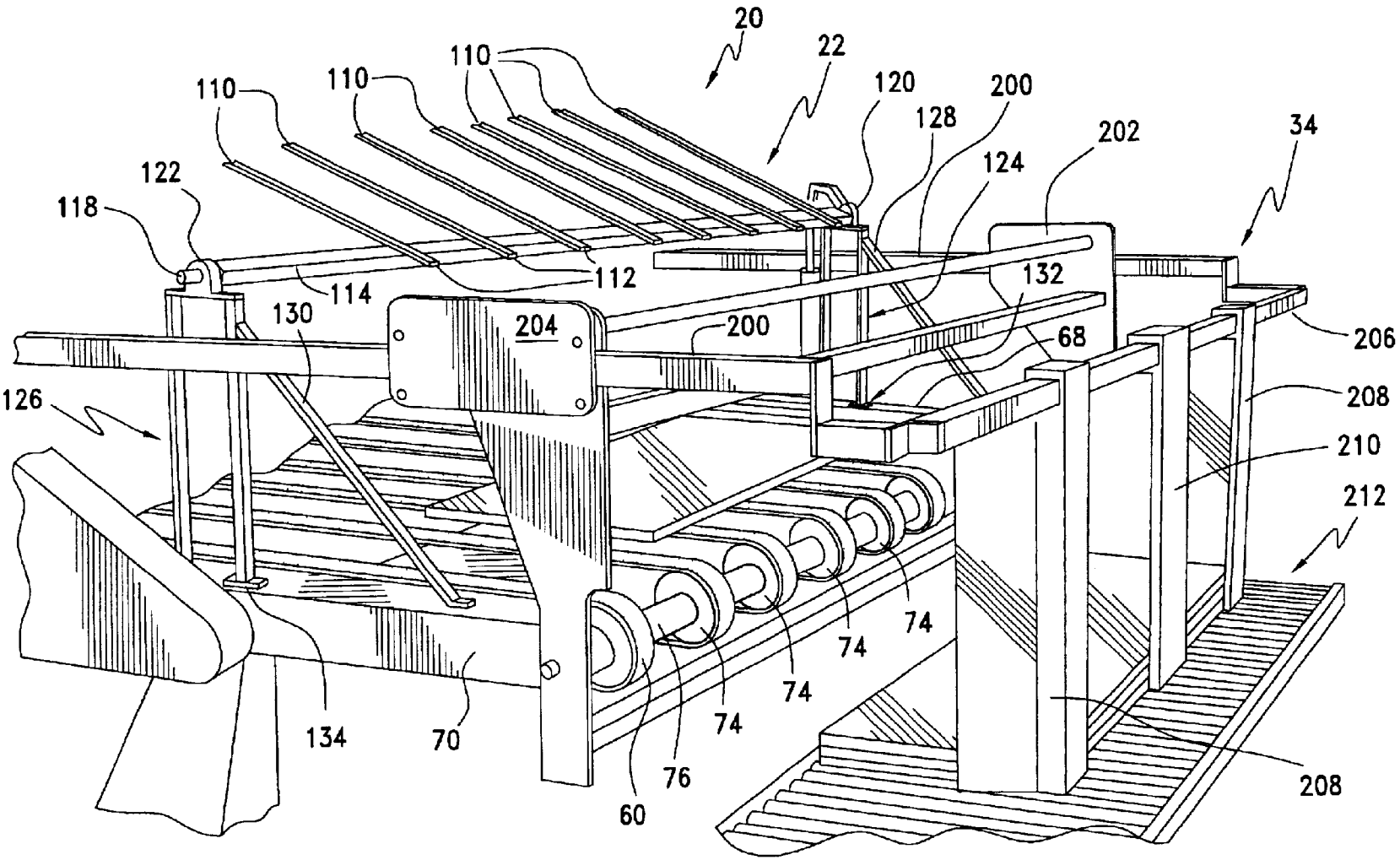
FIG. 13 is a perspective view of the sheet stack receiving hopper of the sheet stacker and showing the sheet inverter with its fingers in a bypass position.

As may be seen by referring to FIG. 8, the sheet stacker, generally at 22 is provided with a plurality of endless belt conveyors 60. These belts 60 are supported at a first or infeed end 62 of the sheet stacker 22 by spaced belt drive pulleys 64, as seen most clearly in FIG. 11, that are secured to a conveyor belt drive shaft 66. Again referring to FIG. 8, conveyor belt drive shaft 66 extends between spaced, parallel side frames 68 and 70 of the sheet stacker 22. A drive power source 72 for the conveyor belt drive shaft 66 is depicted schematically in FIG. 8. As depicted in FIG. 13, the endless belt conveyors 60 extend under the sheet inverter 20 and around idler pulleys 74 which are carried by an idler pulley shaft 76 that also extends between the side frames 68 and 70 of the sheet stacker 22. It will be understood that sheet stacker 22 is also generally known in the industry. A particularly suitable sheet stacker 22 for use in corrugated box blank manufacturing facilities, that is useable with the sheet inverter 20 of the present invention, is manufactured by Greene Line Manufacturing Corporation of Walton Hills, Ohio. However the sheet inverter 20 is also useable with other sheet stackers 22.

Again referring to FIG. 1, the printed, slotted and scored corrugated paperboard box blanks 30 are ejected from the printer-slotter 28 onto an intermediate accumulating conveyor, generally referred to as a lay boy, as indicated at 32. The lay boy 32 is positioned between the printer-slotter 28 and the sheet stacker 22. It acts to accumulate the stacks 24 of the box blanks 30 which are then sent to the sheet stacker 22 and are inverted or flipped by the sheet inverter 20. The lay boy 32 is driven, typically in an intermittent manner, by a chain drive from a drive clutch 80 and drive sprocket 82 which are carried by the belt drive shaft 66 of the sheet stacker 22, as seen most clearly in FIG. 11. The lay boy 32 includes a plurality of spaced, parallel conveyor belts 84, as seen in FIGS. 1–8 and 11 that are supported by driven pulleys 86 which, as seen in FIG. 11, are spaced along a driven shaft 88 of lay boy 32. As also may be seen in FIG. 11, the driven shaft 88 is provided with a driven sprocket 90 which is connected to the drive sprocket 82 on the conveyor belt drive shaft 66 of the sheet stacker 22 by a suitable drive chain 92. A lay boy driven shaft brake 94 is also carried on the lay boy driven shaft 88 and will be discussed in detail shortly. Lay boy driven shaft 88 and drive shaft 66 of the sheet stacker 22 are both supported at their ends in suitable bearings 96 and 98, respectively, which are secured to the sheet stacker side frames 68, 70, as seen in FIG. 11. It will be understood that the other shaft ends are supported in similar bearings.

Referring again to FIG. 1, an infeed end 100 of lay boy 32 is situated adjacent to, and spaced from the slotting knife shafts 48 and 50 of the slotter portion of the printer-slotter 28. The infeed end 100 of the lay boy 32 is defined by a plurality of laterally spaced endless conveyors 102. Four such laterally spaced conveyors 102, each including an endless conveyor belt 84, are depicted in FIG. 8. These four laterally spaced endless conveyors 102 are each laterally shiftable along the lay boy driven shaft 88 by lateral shifting of their respective driven pulleys 86. As may be seen in FIG. 1, each of these plurality of laterally spaced endless conveyors 102, which cooperate to form the lay boy 32, includes a downwardly extending leg 105 that carries a support roller 107 at its lower end. Each of the laterally spaced endless conveyors, which define lay boy 32, includes a lay boy idler pulley 104, that is positioned at an infeed end of each laterally spaced conveyor 102, and that cooperates with an associated lay boy driven pulley 86 to support its one of the endless conveyor belts 84. The construction of lay boy 32 using a plurality of laterally spaced endless conveyors 102 allows an operator of the printer-slotter 28 to lift up each one, or selected ones of the laterally spaced conveyors 102, which will each rotate about the lay boy driven shaft 88. This clears the area between the sheet stacker 22 and the printer-slotter 28 so that the positioning of the slotting knives and scoring dies can be adjusted. The lateral width of the lay boy 32 can then be set by lateral positioning of each of the laterally spaced endless conveyors 102 through shifting of each pulley 86 along shaft 88. As may be seen most clearly in FIG. 8, the lay boy conveyor belts 84 and the sheet stacker belt conveyors 60 are parallel but are staggered. This arrangement saves space and accomplishes a more efficient transfer of individual box blanks 30 or stacks 24 of box blanks 30 from the lay boy 32 to the sheet stacker 22. The infeed end 100 of the lay boy 32 is spaced from the printer-slotter 28 so that the scraps of corrugated paperboard cut out of the sheets 26 by the slotting knives 46 and 52 of the slotter will fall into the space between the two when the printed, slotted and scored corrugated paperboard box blanks 30 are ejected from the printer-slotter 28 onto the lay boy 32.

Figures 9, 10:
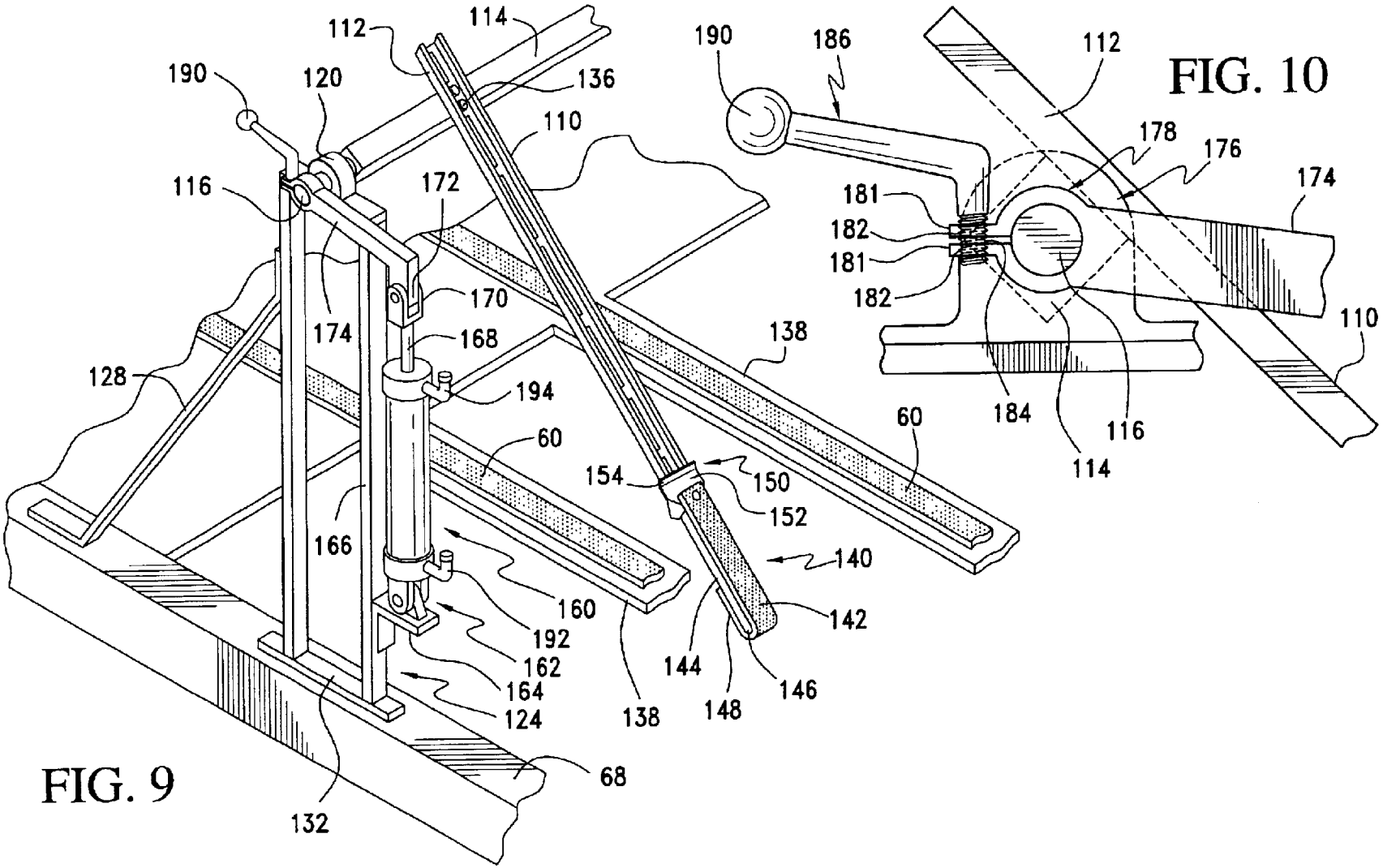
FIG. 9 is a perspective view of a first end of the sheet inverter.
FIG. 10 is an end view of a portion of the sheet inverter shown in FIG. 9.

Before entering into a discussion of the operational sequence of the sheet inverter 20 of the present invention, as depicted in FIGS. 1–7, it will be appropriate at this point to describe, in detail, the structure of the sheet inverter 20. As seen most clearly in FIGS. 8, 9, 10, and 13, a plurality of sheet inverter fingers 110, one of which is shown in detail in FIG. 9, are each secured at first or proximal ends 112 to a transverse finger shaft 114. The finger shaft 114 extends above the sheet stacker 22 and is generally transverse to the belt conveyors 60. As such, it is generally parallel to the belt conveyor drive shaft 66, the belt conveyor idler pulley shaft 76, and the lay boy driven pulley shaft 86 as seen most clearly in FIG. 8. Each end of finger shaft 114 is formed with a finger shaft journal 116 and 118. Each finger shaft journal 116 and 118 is supported in a suitable finger shaft journal bearing 120, 122, as seen most clearly in FIGS. 9 and 13. The two finger shaft journal bearings 120, 122 are placed atop support towers 124 and 126, which also are seen most clearly in FIGS. 9 and 13. These support towers 124 and 126 are depicted as box frames with rearwardly extending brace arms 128, 130. The two support towers 124 and 126 are secured, at lower ends 132 and 134, respectively to the side frames 68 and 70 of the sheet stacker 22. No specific type of securement is depicted in the drawings. It will be understood that any suitable type of attachment between the support towers 124 and 126 and the frame side rails 68 and 70 is within the scope of the present invention.

Again referring primarily to FIG. 9, each sheet inverter finger 110 is bolted to the finger shaft 114 at its proximal or first end 112 by the use of bolts 136. These finger attachment bolts 136 are also exemplary of a variety of connections that are useable to join the fingers 110 to the finger shaft 114. The plurality of sheet inverter fingers 110 are spaced along the finger shaft 114 so that they interdigitate with the spaced belt conveyors 60 of the sheet stacker 22, as seen most clearly in FIGS. 8 and 9. It will be understood, as shown in FIG. 9 that the individual belt conveyors 60 run on upper surfaces of belt supports 138. This is to ensure that the belt conveyors 60 do not sag when they are subjected to the load of a stack of printed, slotted and scored corrugated cardboard box blanks 24, as shown in FIGS. 1–7.

Each sheet inverter finger has a free, distal portion, generally at 140, as seen in FIG. 9. Each such finger distal portion 140 has a friction enhancing surface, typically provided by the use of a friction enhancing material 142 securely attached to its upper or front face 144. A suitable friction enhancing material 142 would be a rubber composite similar to the material used to form the belt conveyors 60. Other method and materials for providing the friction enhancing surfaces are also appropriate. The intent of the friction enhancing surface 142 provided on the front face 144 of the distal portion 140 of each sheet inverter finger 110 is to increase the frictional forces between the fingers 110 and the surface of the lowermost one of the corrugated box blanks 30 in the stack 24 of such box blanks during the inverting operation.

Figure 4:
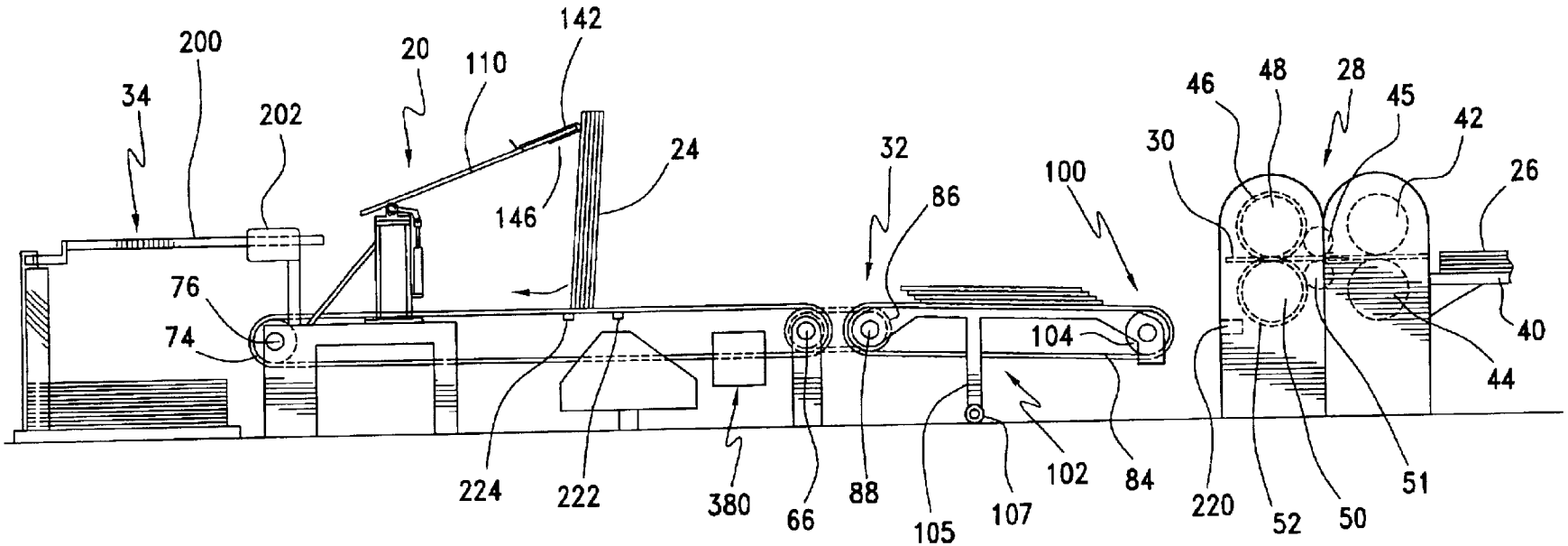
FIG. 4 is the next view in the sequence of operation of the sheet inverter and showing the stack of now-aligned sheets passing a center inverted position.
Figure 5:
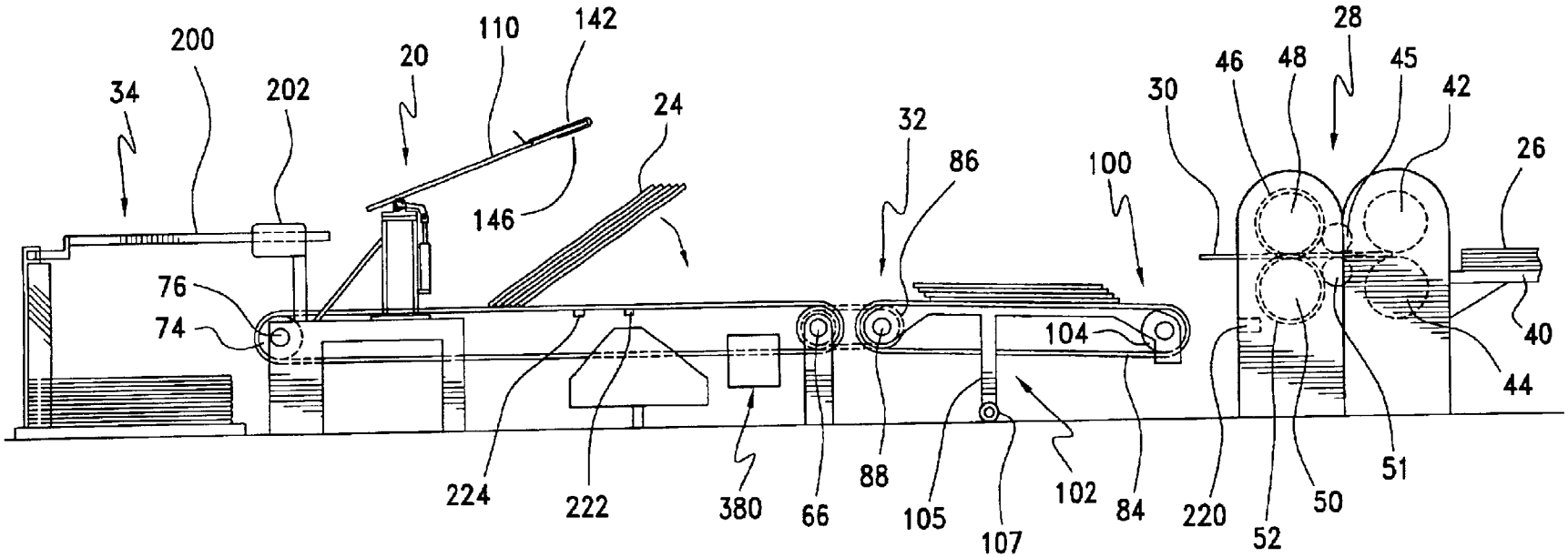
FIG. 5 is another view of the sequence of operation of the sheet inverter and showing the stack of sheets having been inverted.

As is shown in FIG. 9, the friction enhancing surface or material also extends around the distal or free end 146 of each sheet inverter finger 110 and for a short length along the undersurface 148 of the finger distal portion 140. The free end 146 of the finger 110 will act as a pivot point during the inverting of the stack of sheets 24, as depicted in FIG. 4. It is essential that good frictional contact be maintained between the sheet inverter fingers 110 and the box blanks 30 until the stack 24 has been inverted, as depicted in FIG. 5.

Again referring to FIG. 9, each sheet inverter finger 110 is also provided with a sheet stop 150. Each sheet stop 150 is secured to the upper surface 144 of the associated finger 110 at the terminus of the friction enhancing surface or material 142. The sheet stop is a generally transverse plate 152 with a flared flange 154. If the stack 24 of box blanks 30 rides up along the surface of the friction enhancing surface or material 142 during operation of the sheet inverter 22, it will encounter the sheet stop 150. This encounter prevents the stack 24 of box blanks 30 from climbing further up each finger 110. The angle of the flared flange 154 is selected to allow a smooth release of the leading edge of the box blanks 30 in the stack 24 as the inversion of the sheet stack is started.

Rotation of the finger shaft 114, during the sheet inversion process, as performed by the sheet inverter generally at 22 in accordance with the present invention, is accomplished by a double acting pneumatic cylinder, generally at 160, as seen in FIG. 9. Pneumatic cylinder 160 is connected at a lower, pivot joint 162 to an angle bracket 164 which is secured to a side member 166 of the support tower 124 for the finger shaft journal 120. The piston rod 168 of the pneumatic cylinder 160 is connected, by an upper pivot joint 170, such as a pin and clevis joint, to a first end 172 of a crank arm 174. The second end 176 of the crank arm 174 ends in a split collar clamp 178 that has a central aperture 180 which receives the finger shaft journal 116, as seen most clearly in FIGS. 9 and 10. The split collar clamp 178 has a pair of ears 181, each with a threaded bore 182. A threaded end 184 of a clamp handle 186 is screwed into the threaded bores 182 of the aligned ears 181. A free end 190 of the clamp handle 186 has a hand-graspable knob. Rotation of the clamp handle 186 causes the two ears 181 to move either together, or apart, depending on the direction of rotation of handle 186. This will tighten or loosen the split collar clamp 178 on the finger shaft journal 116. Loosening of the clamp 178 will allow rotation of the fingershaft 114 with respect to the crank arm 174. This will allow the angle of declination of the fingers 110 to be finely adjusted.

In use, as will be discussed in detail shortly, the double acting pneumatic cylinder 160, as seen primarily in FIG. 9, can be supplied with compressed air to either side of a central piston (not shown) through suitable fittings 192 and 194. These fittings also allow the exhaustion of compressed air from the two chambers of the cylinder 160. Through the provision of appropriate control valves, the rate of extension and retraction of the piston rod 168, and thus the speed of rotation of the finger shaft 114 and, in turn the rate of elevation and declination of the distal portions 140 of the sheet inverter fingers 110 can be accomplished and controlled. While only one double acting cylinder 160 is specifically discussed, it will be seen, by referring to FIG. 8, that a second, similar cylinder 160 and crank arm assembly 174 could be provided to engage the second finger shaft journal 118.

Turning now briefly to FIGS. 8 and 13, the sheet stack hopper 34 will be described. It will be apparent that the stacks of sheets 24, after having been inverted by the sheet inverter 20, must be collected and stacked in an orderly manner. The sheet stack hopper 34 accomplishes this task. A pair of cantilever support arms 200 are movably connected at their inboard ends, to the side frames 68 and 70 of the sheet stacker 22 by support brackets 202 and 204. These support brackets 202 and 204 are structured to allow the cantilever arms 200 to be slid parallel to the side frames 68 and 70. A transverse rail 206 extends between the outboard ends of the two cantilever arms 200. This transverse rail 206 supports spaced corner stack guides 208 and a center, rear stack guide 210. These stack guides 206 and 208 are slidable along the transverse rail 206 in accordance with the width of the corrugated box blanks 30. The transverse rail 206 is also movable toward or away from the discharge end of the sheet stacker 22; i.e. toward or away from the idler pulleys 74 and their shaft 76, in accordance with the length of the box blanks 30, by movement of the cantilever arms 200 in their respective support brackets 202 and 204.

A suitable roller conveyor, generally at 212, as seen in FIGS. 8 and 13, underlies the sheet stack hopper 34 and receives the stacks 24 of the printed, slotted and scored corrugated paperboard box blanks 30 while exit from the discharge end of the sheet stacker 22. As is known in the art, the sheet stacker 22 is able to have its discharge end elevate during operation. This insures that the arms 200 and 206 and the stack guides 208 and 210 of the sheet stack hopper 34 will also elevate as stacks of sheets 24 are discharged. A suitable sensor, such as an electric eye, which is not specifically shown, can be set to stop the operation of the machine, and to discharge a completed stack from the sheet stack hopper 34 upon the receipt of the appropriate number of printed, slotted and scored corrugated paperboard box blanks in the sheet stack hopper 34. Once the stack of box blanks 30 in the sheet stack hopper 34 has reached its desired number, the sheet stacker discharge end and thus the hopper 34 is further elevated so that the completed stack can then be removed along the roller conveyor 212 for further processing, typically at a joiner such as a stitcher or a taper.

The coordinated activities of all of the above described component parts are essential for the production of corrugated box blanks. The preferred embodiment of control circuits for the parts will be discussed in detail in the subsequent section. It is believed to be appropriate at this juncture to provide a description of the interrelated operations of the component parts. As discussed above, and as seen in FIGS. 1–8, the supply stack 26 of the corrugated sheets received from a supplier, are placed onto the supply platform 40 of the printer-slotter 28. The print roller 42 is provided with suitable plates that will apply the end user's desired graphics to the top surface of each box blank. The male scoring heads 51 cooperate with the female scoring anvils 45 to add the necessary score lines to each box blank. The male and female slotting knives 46 and 52, attached to the slotting shafts 48 and 50, cut out the required slots, handles and other portions of the corrugated paperboard. The run speed of the printer-slotter 28 is set in accordance with several parameters, generally in accordance with the size and weight of the corrugated sheets. This speed can be varied from job to job but will be a constant for each job.

As the printed and slotted corrugated paperboard box blanks 30 are ejected from the printer-slotter 28, they are sensed by a sheet detect photoeye 220, as noted in FIG. 1. Sheet detect photoeye 220 can detect the presence of a sheet 30 by noting the passage of its leading and trailing edges. Alternatively, sheet detect photoeye 220 can be of the type that detects the absence of a sheet; i.e. it is a "dark" sensor. In either instance, the impulses from the sheet detect photoeye 220 are directed to the control system and provide an indicator of sheet quantity and sheet speed exiting the printer-slotter 28.

As seen in FIG. 1, several sheets 30 are on the lay boy 32, which is stopped, while a stack of sheets 24 is moving along the sheet stacker 22 by operation of the belt conveyors 60 which are always moving. As the printer-slotter 28 continues its operation, it will cause the build up of the next stack 24 of sheets 30 on the lay boy. A cycle start photoeye 222 underlies a center one of the belt conveyors 60 of the sheet stacker 22 and is securely attached to the sheet stacker 22. The arrival of a leading edge of a stack 24 of box blanks 30 at the cycle start photoeye 222 initiates the supply of compressed air to the side of the double acting cylinder 160 which extends the piston rod 168 and thus starts the rotation of the finger shaft 114 and the elevation of the distal or free portions 140 of the sheet inverter fingers 110. It is desirable to keep the time between sensing of the sheet stack leading edge by the cycle start photoeye 222, and the contact of the sheet stack leading edge with the fingers 110 at a minimum. This time minimization can be accomplished by manually adjusting the rest position of the sheet fingers 110 using the split collar clamp 178. Fine adjustment of the finger position is accomplished by loosening the clamp 178 and by manually slightly rotating the finger shaft 114.

Figure 2:
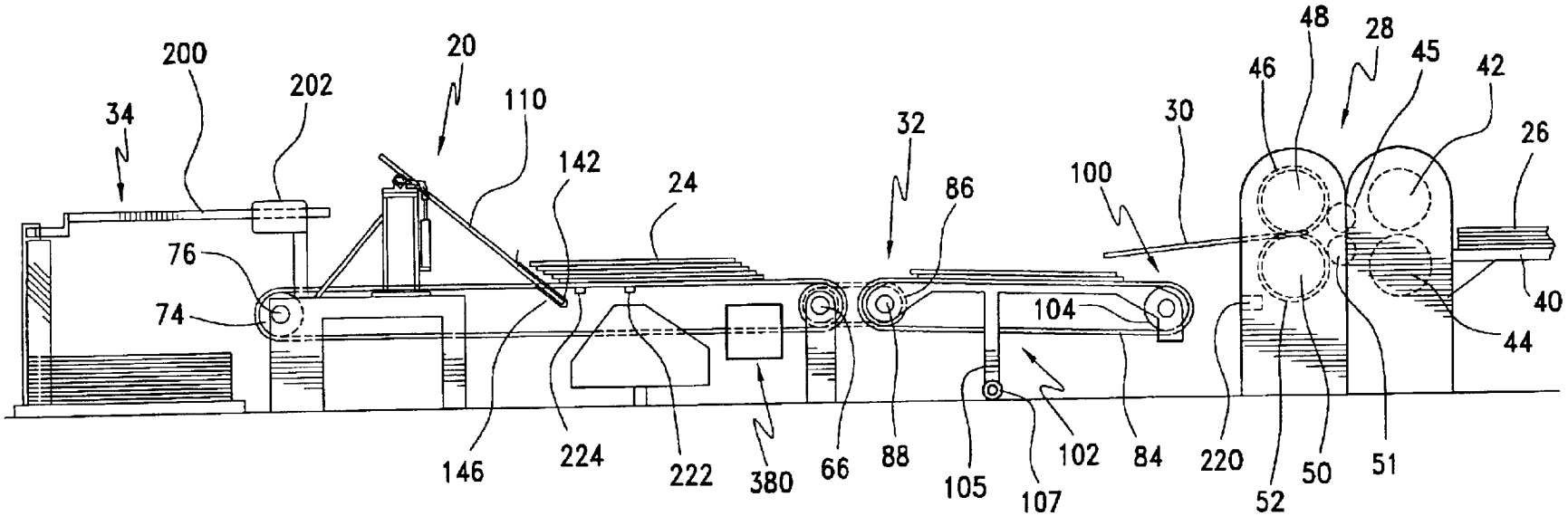
FIG. 2 is a view similar to FIG. 1 and showing the sheet inverter starting a sheet inversion operation of a stack of displaced sheets.
Figure 3:
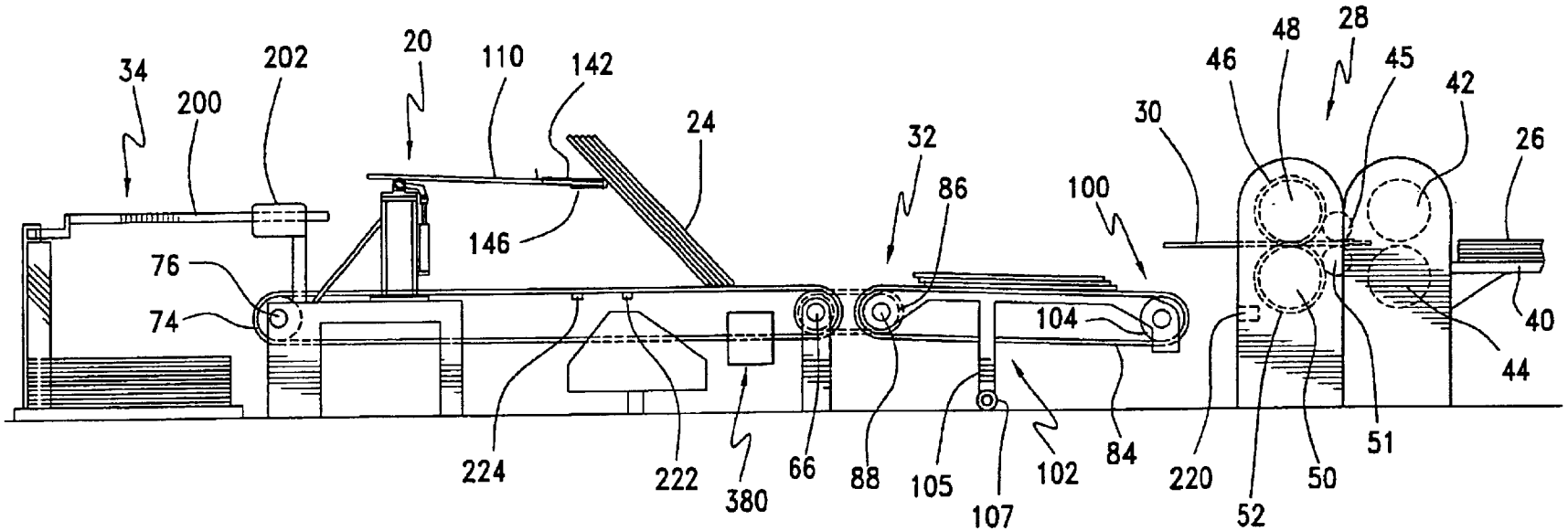
FIG. 3 is another view in the sequence of operation and showing the initiation of sheet stack inversion with the initial alignment of the displaced sheets in the stack of sheets.

As is shown in FIG. 2, the next printed, slotted and scored corrugated paperboard sheet 30 is now about to be placed on the stack being formed on the lay boy. The friction enhancing surfaces 142 of the distal portions of the sheet inverter fingers 110 are now in engagement with the leading edges of the lowermost one of the box blanks 30 in the stack 24 undergoing inversion. The sheet inverting fingers 110 continues to elevate the leading end of the stack 24, as shown in FIG. 3 while the trailing edges of the stack 24 now start to pivot on the belt conveyors 60. This will cause a momentary skewing of the stack as the upper sheets slide slightly with respect to the lower ones. Such a skewing is only minor and is self-correcting.

The free ends 146 of the sheet inverting fingers 110 become pivot points as the stack 24 reaches a generally vertical position, as shown in FIG. 4. Once the sheet stack 24 passes a center position, it will fall back onto the belt conveyors 60 in an inverted position. What was the trailing edge of the stack 24 will now be the leading edge. What was the top surface of the stack will now be its bottom surface. The forming stack 24 on the lay boy continues its accumulation as the printer-slotter 28 continues to run.

In FIG. 5, it will be seen that the stack has now passed the center position and is falling back onto the belt conveyors 60 of the sheet stacker 22. All of this sheet stack inversion takes place in a short period of time which is a set time that varies in accordance with belt speed and stack height.

Figure 6:
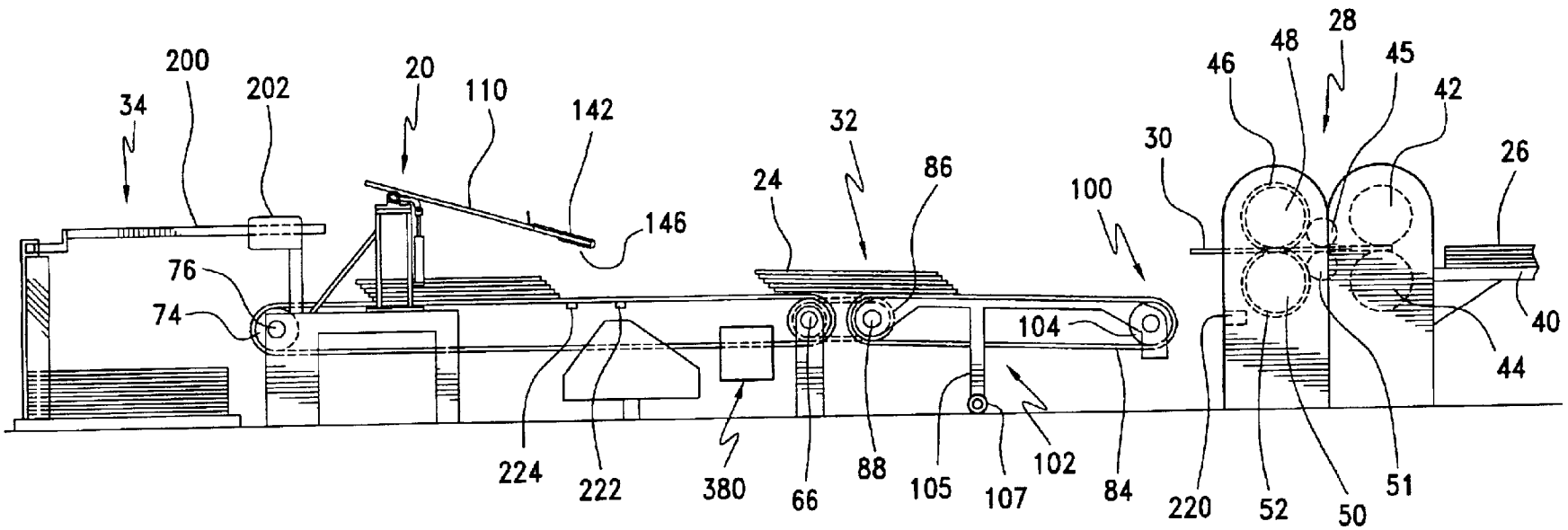
FIG. 6 is the next schematic side elevation view showing the inverted stack of aligned sheets exiting the sheet inverter.

Turning to FIG. 6, it will be noted that several actions are taking place concurrently. The now inverted sheet stack's trailing edge has cleared a jam prevent photoeye 224. This is located after, in the direction of travel of the sheet stacker 24, the cycle start photoeye 222 and is also secured to the support structure for the sheet stacker 24. After the passage of a set period of time, in which the stack of sheets 24 should have been inverted, the double acting cylinder 160 is caused to retract its piston rod 168. Air previously supplied to the first or extension chamber of the cylinder is now exhausted. Compressed air is concurrently supplied to the second or retraction chamber of the cylinder 160. This starts the declination of the sheet inverter fingers 110 so that they will be ready to engage the next stack 24 which will be arriving shortly. If the previously inverted stack 24 has not cleared the area beneath the dwell point of the distal ends 140 of the fingers 110, continued declination of the finger ends 140 could cause them to engage the inverted sheet stack 24 which has not fully exited. The jam prevent photoeye 224, in conjunction with its associated controls, as will be discussed shortly, prevents return of the distal ends 140 of the sheet inverter fingers 110 to their rest position, as seen in FIG. 1, until their path is clear.

At the same time as the fingers 110 are approaching their start position, the control system signals the drive clutch 80 to engage. This engagement of drive clutch 80 turns drive sprocket 82 so that drive chain 92 is driven. Driven sprocket 90 on the lay boy driven shaft 88 is turned because the lay boy driven shaft brake 94 is also now disengaged. A suitable run time for the lay boy driven shaft 88 is provided to accomplish the feeding of the now completed stack of sheets 24 from the lay boy 32 to the sheet stacker 22. As soon as this run time is completed, the sheet stacker drive shaft clutch 80 is disengaged. At the same time, the lay boy driven shaft brake 94 is engaged. This prevents any "drifting" of the lay boy driven shaft 88 and any associated movement of the lowest sheet 30 with respect to the subsequently received sheets as the stack 24 again starts to build on the lay boy. This portion of the overall progression is shown in FIG. 6.

Figure 7:
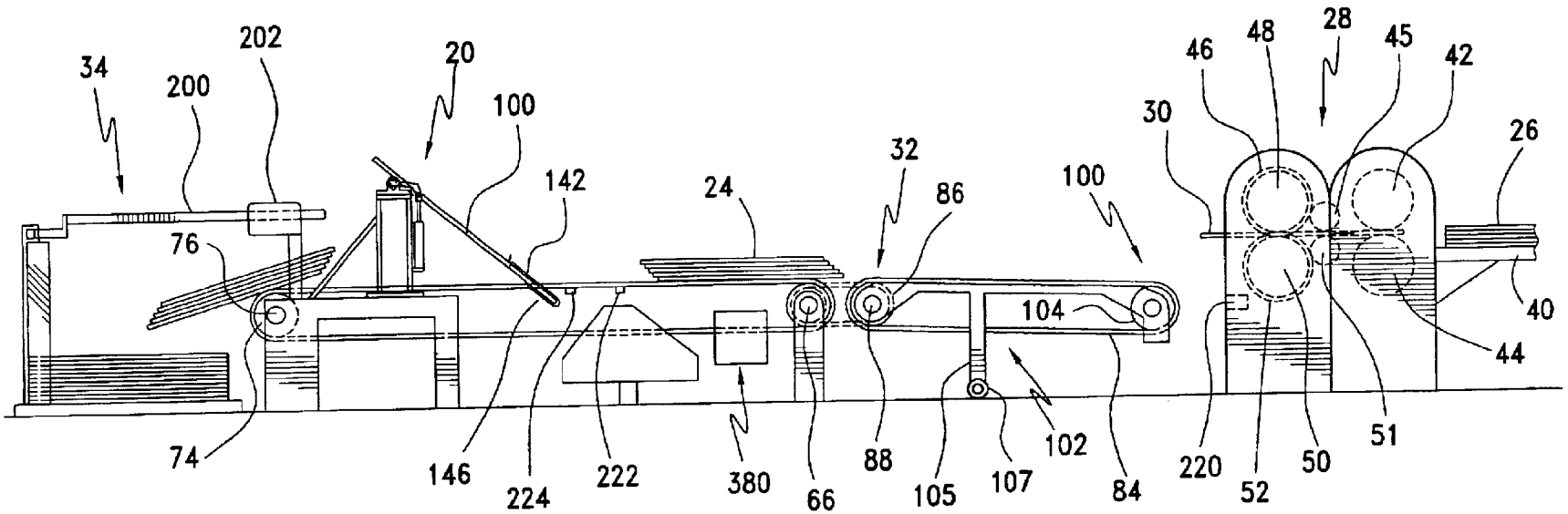
FIG. 7 shows the sheet inverter again in the ready position and awaiting the arrival of the next stack of sheets to be inverted.

FIG. 7 represents a return to the start of the cycle. In FIG. 7, the next stack 24 of sheets 30 has not yet arrived at the cycle start photoeye 222. The previously inverted stack 24 of printed, slotted and scored corrugated box blanks 24 is leaving the discharge end of the sheet stacker and will be added to the accumulating stack in sheet stack hopper 34.

Before entering into a detailed description of the control assembly, it is to be noted that the speed of travel of the sheet stacker is a function of the number of sheets 30 built up in each stack 24 on the lay boy 32. A typical number of sheets 30 in a stack 24, if the sheets 30 are single corrugated sheets, is five to nine and preferably six or seven. If the printer-slotter 28 must run at a slower speed, because the individual sheets 30 are thicker or require more complex printing or slotting, it may be appropriate to accumulate only two or three sheets in each of the sheet stacks 24. If necessary, and assuming a sufficiently slow run speed, each individual sheet 30 can be inverted. This is possible, even taking into consideration the inherent flexibility of the corrugated paperboard box blanks, due in part to their plurality of slots and score lines.

In certain situations, such as with very large box blanks 30 or with blanks that are even more highly flexible, it may be desirable to provide several of the sheet inverter fingers 110 with finger extensions, generally at 230, as seen in FIG. 12. Each such finger extension, generally at 230, includes a single acting pneumatic cylinder 232 that is secured to the lower surface 148 of the distal portions 140 of selected ones of the sheet inverter fingers 110, as shown in FIG. 8. The piston rods 234 of these finger extension cylinders 232 each carry a resilient ball or knob 236 that is also made of a friction enhancing material. The piston rods 234 of the finger extensions 230 can be extended by compressed air and can be retracted by internal coil springs once the compressed air has been vented. Not all of the stack inverter fingers 110 will typically be provided with the finger extensions 230 and the finger extensions 230 will not always be used. As noted above, these extensions 230 are typically used with large or oversized flexible corrugated box blanks having larger flaps that may require the fingers 110 to have an extended reach to ensure that the sheets 30 or the stacks 24 of sheets are properly inverted by engagement of the knobs 234 with the bodies of the sheet 30, not with their flaps.

Figure 14:
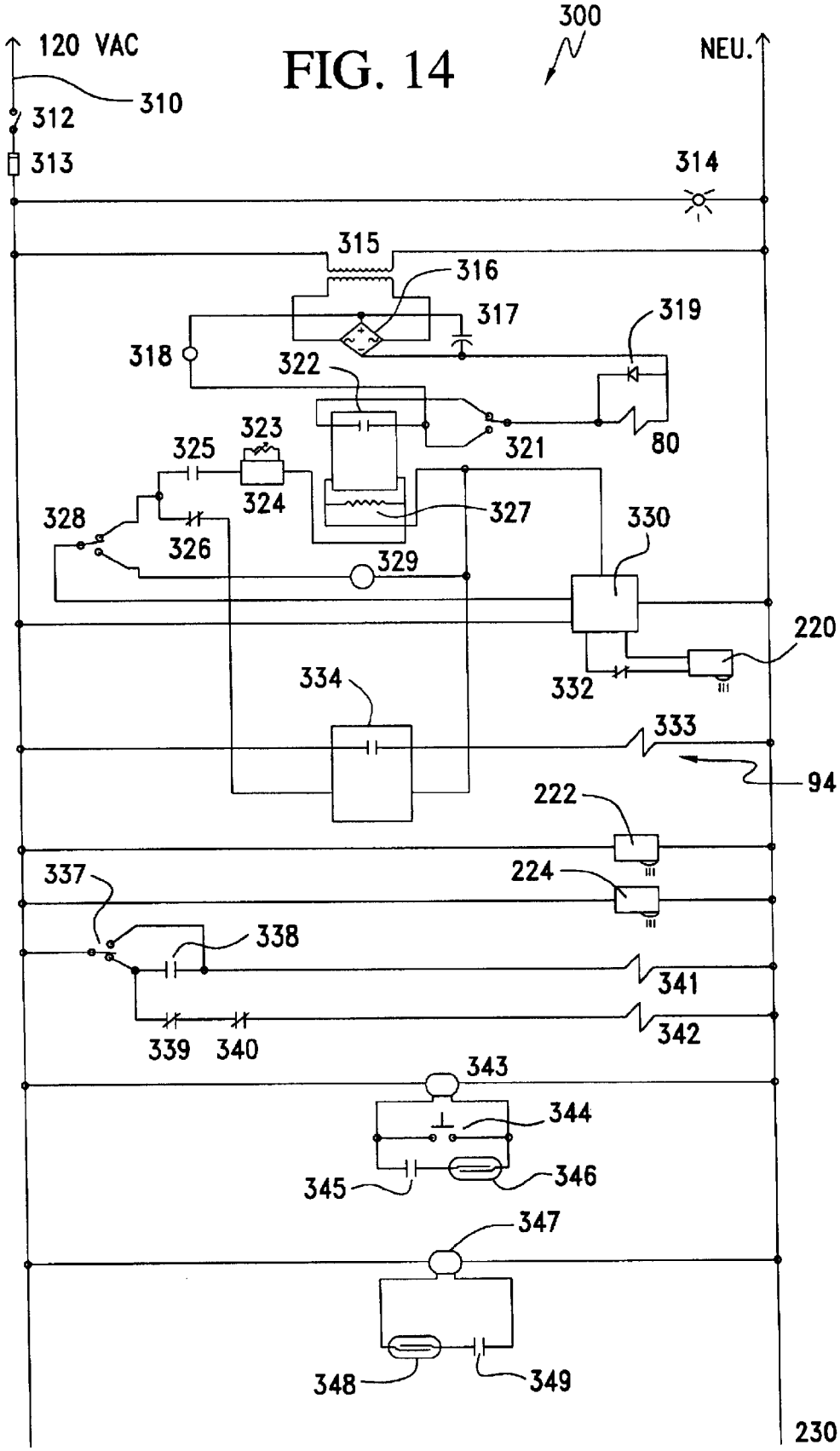
FIG. 14 is an overall schematic depiction of the electrical control arrangement for the subject invention.

Turning now to FIG. 14 there may be seen generally at 300 a schematic for the control assembly of the sheet inverter in accordance with the present invention. 120 volt A.C. power, generally at 310, which is supplied by a suitable power source, flows through a first switch 312 and a fuse 313 and energizes an indicator light 314. The power is stepped down by a transformer 315. The resultant reduced A.C. power of the transformer secondary 315 is rectified by a bridge rectifier 316, filtered by a capacitor 317 and is current limited by a suitable circuit breaker 318. A lay boy switch 321 is set in a run position so that a first set of contacts of lay boy switch 321 will supply uninterrupted power to the drive clutch 80 and to a snubbing diode 319. The drive clutch 80 is thus continuously engaged and the lay boy brake 94 is disengaged. This will allow the lay boy conveyor belts 84 to run continuously. Simultaneously, a second set of contacts on switch 328 will energize a relay 329 which will hold open contacts 332 on relay 329. This interrupts the infeed signal from the sheet detect photoeye 220 to thereby prevent inadvertent operation of the sheet inverter 20. This position of the assembly is utilized if it will not be necessary to invert the sheets. In this mode of operation, the sheets exit the printer-slotter 28 and are conveyed by the lay boy 32 and the sheet stacker 22 directly to the sheet stack hopper 34.

To place the sheet inverter 20 into operation, the lay boy switch 321 is moved to a "stack" position. Switched power is applied from the lay boy switch 321, which can be a double pole, double throw toggle switch, to the lay boy clutch 80 and to the snubbing diode 319. This starts and stops the lay boy conveyor belts to accomplish stacking of the printed, slotted and scored corrugated paperboard box blanks on the lay boy 32. At the same time, the second set of contacts 328 on the lay boy toggle switch 321 are opened to disengage the relay 329 thus closing contacts 332 and restoring the sheet detect photoeye 220 input signal so that the sheet inverter 20 will be operational. The sheet detect photoeye 220 can detect both leading and trailing edges of corrugated box blanks 30 which pass it. Such sensing imparts a negative pulse and a positive pulse to a programmable counter 330. The counter 330 may be configured as a two edge counter with a scale factor set to multiply the count input by 0.50. With this configuration, only the sheet's trailing edge, regardless of sheet length, advances the counter by one thus minimizing the time delay needed for the last sheet to be placed on the stack 24 on the lay boy 32 before the lay boy is operated to transfer the stack 24 to the sheet stacker 22. The amount of time delay needed is a function of the distance the sheet detect photoeye 220 is from the stack 24 and the velocity at which each sheet 30 is ejected from the printer-slotter 28. It will be understood that the type of stack detect photoeye 220 used, as well as the type of programmable counter 330 could be varied. As discussed previously, sheet detect photoeye 220 could be a "dark sense" photoeye that would sense spacings between adjacent sheets. In such a situation, it would not be necessary to use a multiplication factor of 0.50 in the counter.

When a programmed stack count has been reached by the counter 330, a set of contacts 325 in the counter 330 are closed to engage a time delay module 324 through a resistor 327. The time delay in this delay module 324, required for the last sheet 30 to leave the printer-slotter 28 and to be received on the stack of sheets 24 on the lay boy 32, is adjusted by a potentiometer 323. Simultaneously, contacts 326 in the counter 330 open to de-energize a solid state relay 334 and solenoid 333. This releases the lay boy driven shaft brake 94. The clutch 80 and the lay boy drive shaft brake solenoid 333, operating complementarily, position a first sheet 30 exiting from the printer-slotter 28 in the correct location on the lay boy so that the trailing edge of the first sheet 30 will be sufficiently forward of the infeed end 100 of the lay boy to allow scrap generated during the slotting operation to fall between the printer-slotter 28 and the trailing edge of the stack 30 on the lay boy 32. The final position of the first sheet 30 on the lay boy 32 is determined by the run time of the lay boy conveyor belts 84 and is adjustable through a programming function of the counter 330.

Once a stack 24 of sheets 30 has been received on the belt conveyors 60 of the sheet stacker 32, it moves forwardly until its leading edge is sensed by the cycle start photoeye 222. This sensing of the stack leading edge closes contacts 345 and initiates a one shot "cycle" relay 343. With cycle one shot relay 343 initiated and with switch 337 in the sheet invert position, current flows through contacts of switch 337 and one shot relay contacts 338 thus energizing a first four way air valve solenoid 341 that supplies air to the double acting pneumatic cylinder 160 and thus causes the finger shaft 114 to rotate in a first direction and to thereby raise the lifting fingers 110. The lifting time of the solenoid 341 is determined by the cycle time of the one shot relay 343 through its duration setting capability. After the one shot relay 343 resets, current then flows through the normally closed contacts of one shot relay 339 and one shot relay 340 thus energizing the fingers down four way valve solenoid 342 thereby returning the sheet inverting fingers 110 back down to their start position. Simultaneously, the normally open contacts of the one shot relay 338 open thereby de-energizing the fingers "up" four way air valve solenoid 341. Reed switch 346 senses the return to the "home" position of the double acting pneumatic cylinder 160 and is held closed when the cylinder 160 is fully retracted so that the lifting fingers 110 are in their down position. A cycle switch 344 is provided to manually initiate the sheet stack inverting process. A jam prevent one shot relay 347 is initiated upon coincidental closure of contacts 349 on the jam prevent photoeye 224, which are closed when the jam prevent photoeye 224 detects a stack of sheets 24, and reed switch 348 which is closed when the lifting cylinder piston 160 is sensed at a mid-body position. This coincidental closure opens contacts which are normally closed on a one shot relay 340 to de-energize the fingers "down" four way air valve solenoid 342. This will stop the downward travel of the sheet inverter fingers 110 unless the stack of sheets 24 has passed the jam prevent photoeye 224. The fingers will remain in this position for the duration of a one shot relay 347 that has a preset time which is sufficient to allow an operator to respond to the situation so that the stack of sheets which have not yet left the area under the sheet inverter 20 will not be damaged.

Figure 15:
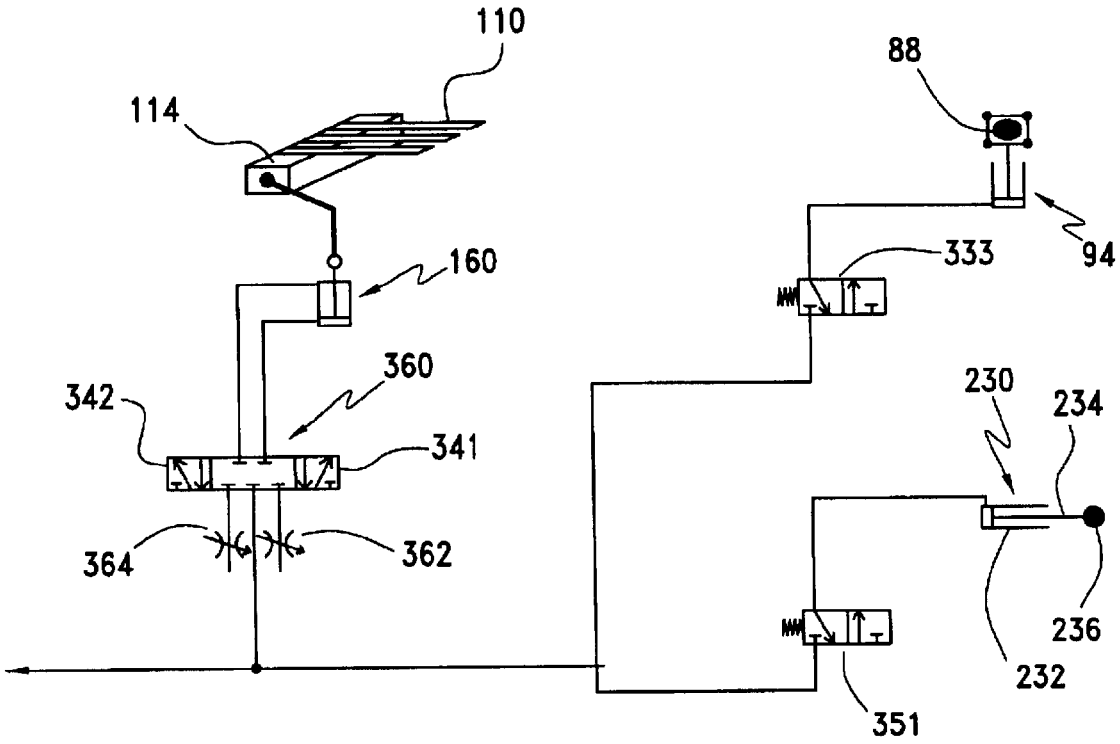
FIG. 15 is a schematic of the fluid control for the sheet inverter fingers, the lay boy brake and the finger extensions.

Now referring to FIG. 15, in conjunction with FIG. 14, the four way, three position center closed pneumatic valve 360 operates the double acting pneumatic cylinder 160 by useage of the solenoids 341 and 342, as discussed above. Air can be trapped in the cylinder 160 so that when the jam prevent photoeye 224 senses the presence of a stack 24 of sheets 30, the sheet inverter fingers 110 will not be able to cycle down to their start position. Suitable speed controls 362 and 364 are used to control the lift and descent rates of the sheet inverter fingers 110 by controlling the flow of compressed air to and from the cylinder 160 through the four way valve 360. These speed controls 362 and 364 are essential to the lifting and pulling functions needed to be performed by the sheet inverter fingers 110 to accomplish the successful inverting of lightweight, flexible corrugated sheets 30. These speed controls 362 and 364 cooperate with the belt conveyor 60 speed settings to provide the optimum lifting and pulling effect on sheets 30 in the stack 24 to be inverted. If the rate of lift is too fast, the trailing edges of the stack 24 will lose contact with the belt conveyors 60. This will reduce the forward driving motion which the belt conveyors 60 must impart to the initialing trailing edges of the sheets 30 in the sheet stack 24 to accomplish successful sheet inversion. If the lift rate is too slow, the forward speed of the stack 24 will drive the stack too far up the surface of the distal ends 140 of the sheet inverting fingers 110. This will cause the sheet leading edges to possibly override the sheet stops 150 thus resulting in a possible jam of the sheet inverter that will necessitate a shutdown.

Again referring to both FIGS. 14 and 15, the closing of the contacts in a toggle switch 350 will energize a solenoid 351 that opens a supply of compressed air to the finger extension cylinders 232. The piston rods 234 of these cylinders 232 will thus extend so that the balls or knobs 236, of a friction enhancing material, will extend. These will accommodate the extra long flaps on sheets 30 without having to physically relocate the lifting fingers 110. This effectively changes the lifting points of the fingers 110 by enabling a longer reach of the fingers 110 thus preventing jams which might otherwise be occasioned by the attempted inversion of stacks 24 of sheets 30 with longer flaps. Such long flapped sheets 30 might otherwise only have the flaps bent by the sheet inverting fingers 110.

The solenoid 351, as seen in FIG. 15 is a three way, two position, normally closed solenoid. The cylinder 232 of the finger extension 230 is provided with internal springs that will retract the piston rods 234 and the balls 236 when the air pressure supply to the cylinders 232 is shut off.

When solenoid 333 is opened, a three way, two position, normally closed pneumatic valve is opened to pressurize the single acting cylinder portion of the lay boy brake 94. This actuation of the lay boy brake 94 will stop the rotation of the lay boy driven shaft 88. An internal cylinder spring releases the lay boy brake 94 when the solenoid 333 is deenergized. It will be recalled that the drive clutch 80 and the lay boy brake 94 act in cooperation with each other. When the drive clutch 80 is engaged, the lay boy brake 94 is disengaged. As soon as the drive clutch 80 is deactivated, the lay boy brake 94 is activated. The result is a coordinated operation that ensures that the lay boy conveyor belts 84 will be positively driven and will also be positively stopped. This ensures that each stack 24 of sheets 30 will be accumulated at the proper location in the lay boy 32.

Figure 16:
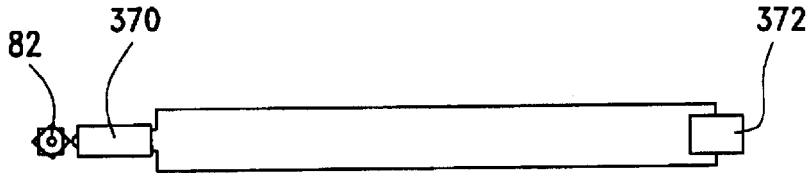
FIG. 16 is a depiction of a conveyor belt speed sensor for use in the sheet inverter in accordance with the present invention.

It is necessary to know the speed of travel of the belt conveyors 60 of the sheet stacker 22 to ensure that the sheet inverter 20 will operate at the correct times. As depicted schematically in FIG. 16, a plurality of pulses are generated in a sensor 370 that is positioned adjacent the toothed drive sprocket 82 which is carried by the conveyor belt drive shaft 60 of the sheet stacker 22. The sensor 370 is preferably a magnetic sensor which generates a pulse each time that a tooth, which is carried on the drive sprocket 82, passes by the sensor 370. A suitable tachometer 372 is connected to the sensor 370 and provides the speed information that is required by the control circuit or by the operator to coordinate the activities of the lay boy 32, sheet stacker 22, sheet inverter 20 and the like to ensure that the assembly described above will operate properly, It will be understood that all of the air lines, electric cables, wires and other similar lines are not depicted in the subject drawings. Such lines, leads and wires are generally well known and their addition to FIGS. 1–13 would render the inventive aspects of the subject invention less visible. A control box or panel is depicted at 380, as seen in FIGS. 1–8. It will be understood that this is merely for purposes of illustration and that such a control panel 380, which houses a number of the switches and controls described previously, could be positioned at any convenient location.

The sheet inverter 20 in accordance with the present invention has been described and discussed primarily in the context of its use in the inverting of stacks 24 of flexible slotted and scored single layer corrugated paperboard box blanks 30. That is its principle intended function. It is able to accomplish this function because of the structure of the sheet inverting fingers 110 and the control of the operational speeds and sequences of the lay boy 32 and the sheet stacker 22 to deliver stacks 24 of the flexible corrugated box blanks 30 at the proper time and with the proper spacing. The sheet inverter 20 in accordance with the present invention is also useable to invert single sheets, particularly but not exclusively flexible ones. The necessity to run the printer-slotter 28 at a slower speed to accommodate thicker or more complicated box blanks 30 may mean that each flexible sheet is inverted individually. The sheet inverter 20 of the present invention may not be used at all in some production selections. If the printer-slotter 28 is a "top" printer, and if the joiner that will receive the printed, slotted and scored box blanks 30 folds the flaps or ends of each blank down and in, then it will not be necessary to include an inverting step. In that case as discussed previously, the sheet inverter 20 will be placed in a bypass position, as depicted in FIG. 13, in which its fingers 110 are raised out of the way. In such instances, the lay boy 32 and the sheet stacker 22 operate continuously so that the blanks 30 exit the printer-slotter 28 and travel to the sheet stack hopper 34 in an uninterrupted fashion.

While a preferred embodiment of a sheet inverter in accordance with the present invention has been set forth fully and completely hereinabove, it will be apparent to one of skill in the art that various changes in, for example, the specific drive for the sheet stacker, the type of printing and slotting, the overran sizes of the various components and the like could be made without departing from the true spirit and scope of the present invention which is accordingly to be limited only by the following claims.

What is claimed is:

1. A sheet inverter comprising:

a sheet conveyor having spaced belts adapted to support at least one flexible sheet of material;

means for moving said spaced belts in a sheet transport direction;

a finger shaft supported for rotation above, and transverse to said spaced belts;

a plurality of sheet inverter fingers each having a first end portion secured to said finger shaft, and a second ends portion interdigitating with said spaced belts, said plurality of sheet inverter fingers being spaced along said finger shaft;

an upper face, a distal end and an undersurface on each of said sheet inverter finger second end portions;

a friction increasing surfaces on said at least upper face of said second end of said sheet inverter finger, said friction increasing surface being adapted to increase a frictional force between said upper face and a lower face of said at least one flexible sheet of material in said sheet transport direction; and means for rotating said finger shaft to elevate and declinate said second end portion of each of said sheet inverter fingers, said friction increasing surface engaging said lower face of said at least one flexible sheet of material during said elevation of said second end portion of each of said sheet inverter fingers in response to said rotation of said finger shaft.

2. The sheet inverter of claim 1 further including a sheet stop secured to each said sheet inverter finger.

3. The sheet inverter of claim 2 wherein each of said sheet stops includes a transverse plate and a sheet stop flange.

4. The sheet inverter of claim 2 further including stack forming means associated with said sheet conveyor.

5. The sheet inverter of claim 4 wherein said stack forming means is an intermediate conveyor.

6. The sheet inverter of claim 5 further including a drive for said conveyor belts, said drive also driving said intermediate conveyor and wherein said drive for said conveyor belts includes a clutch and said intermediate conveyor includes a brake.

7. The sheet inverter of claim 1 wherein said friction increasing surfaces includes said upper face, said distal end and said undersurface of each of said sheet inverter finger second end portions.

8. The sheet inverter of claim 1 wherein said friction increasing surface is a material secured on said second end portion of each of said sheet inverter fingers.

9. The sheet inverter of claim 8 wherein said material is rubber.

10. The sheet inverter of claim 1 further including side frames for said sheet inverter and wherein said finger shaft is supported by said side frames.

11. The sheet inverter of claim 10, further including support towers secured to said side frames and supporting said finger shaft.

12. The sheet inverter of claim 1 wherein said means for rotating said finger shaft includes at least one double acting piston and a crank arm, said crank arm being interposed between said double acting piston and said finger shaft.

13. The sheet inverter of claim 12 further including an adjustable clamp interposed between said crank arm and said finger shaft.

14. The sheet inverter of claim 13 wherein said adjustable claim includes a clamp handle adapted to loosen and tighten said adjustable clamp.

15. The sheet inverter of claim 1 further including sheet sensing means associated with said sheet conveyor and control means interposed between said sheet sensing means and said means for rotating said finger shaft in response to signals generated by said sheet sensing means.

16. The sheet inverter of claim 15 wherein said sheet sensing means includes first and second sensors spaced along said sheet conveyor in said direction of movement of said spaced belts.

17. The sheet inverter of claim 1 further including controls for regulating a rate of elevation and declination of said sheet inverter fingers.

18. The sheet inverter of claim 1 wherein said flexible sheets are corrugated paperboard box blanks.

19. The sheet inverter of claim 18 further wherein said corrugated paperboard box blanks have leading edges, said leading edges engaging said friction increasing surface each said sheet inverter finger second end portion during inverting of said flexible sheets.

20. The sheet inverter of claim 1 wherein said flexible sheets of material are stacks of corrugated paperboard box blanks.

21. A method for inverting flexible sheets including:

providing a sheet conveyor including spaced conveying belts;

supporting said conveying belts for movement in a sheet conveying direction positioning a finger shaft for rotation above and transverse to said spaced conveyor belts;

providing a plurality of sheet inverter fingers with each of said sheet inverter fingers having a first end portion and a second ends portion;

securing said first ends portion of each of said sheet inverter fingers to said finger shaft;

locating said second ends portion of each of said sheet inverter fingers interdigitating with said spaced conveyor belts;

providing an upper face, a distal end and an undersurface on said second end portion of each of said sheet inverter fingers;

providing a friction increasing surfaces on at least said upper face of said second ends portion of each of said sheet inverter fingers;

selecting said friction increasing surface for increasing a frictional force between said upper face and a lower surface of said sheets to be inverted in said sheet conveying direction;

supporting said sheets to be inverted on said spaced conveyor belts;

moving leading ends said sheets to be inverted into contact with said friction increasing upper face of each said sheet inverter fingers; and rotating said finger shaft to elevate said second ends portions of said plurality of said sheet inverter fingers to elevate leading ends of said flexible sheets while maintaining contact between said friction increasing surface and said lower surface of said sheets to be inverted.

22. The method of claim 21 further including providing a sheet stop on each of said sheet inverter fingers and locating each said sheet stop intermediate said first and second ends portions of each said sheet inverter finger.

23. The method of claim 21 further including providing said flexible sheets as corrugated paperboard box blanks.

24. The method of claim 21 further including providing said flexible sheets as stacks of sheets.

25. The method of claim 21 further including providing an intermediate conveyor and using said intermediate conveyor for forming said stacks of sheets.

26. The method of claim 21 further providing sheet sensors on said sheet conveyor and using signals from said sheet sensor for controlling said rotating of said finger shaft.

* * * * *